United States Patent [19]

Kondo

[11] 4,077,298

[45] Mar. 7, 1978

[54] APPARATUS FOR AUTOMATICALLY TUNING AN ELECTRONIC MUSICAL INSTRUMENT

[75] Inventor: Nobuaki Kondo, Minamisaitama, Japan

[73] Assignee: Kabushiki Kaisha Kawai Gakki Seisakusho, Hamamatsu, Japan

[21] Appl. No.: 735,212

[22] Filed: Oct. 22, 1976

[51] Int. Cl.[2] ..... G10G 7/02

[52] U.S. Cl. ..... 84/454; 84/1.01; 84/DIG. 18

[58] Field of Search ..... 84/454–456, 84/1.01, 1.03, DIG. 18; 354/79 D, 78 D, 81, 83 D, 82

[56] References Cited

U.S. PATENT DOCUMENTS

| | | | |
|---|---|---|---|
| 3,472,116 | 10/1969 | Schott | 84/1.01 |
| 3,800,060 | 3/1974 | Hallman, Jr. | 84/1.24 |
| 3,878,754 | 4/1975 | Barnum | 84/454 |
| 3,901,120 | 8/1975 | Youngquist | 84/454 |
| 3,943,814 | 3/1976 | Wemekamp | 84/1.01 |
| 3,956,961 | 5/1976 | Peterson | 84/1.24 |

FOREIGN PATENT DOCUMENTS

| | | | |
|---|---|---|---|
| 2,435,346 | 5/1976 | Germany | 84/DIG. 18 |
| 2,559,092 | 7/1959 | Germany | 84/454 |

*Primary Examiner*—Robert K. Schaefer
*Assistant Examiner*—Vit W. Miska
*Attorney, Agent, or Firm*—Haseltine, Lake & Waters

[57] ABSTRACT

An apparatus for the automatic tuning of an electronic musical instrument comprising a phase comparator, a converter circuit connected to the comparator for converting an output signal of the phase comparator into a voltage of a magnitude corresponding thereto, a sample hold circuit connected in series with the converter circuit, a calculation circuit having a first input connected to the sample hold circuit and a voltage control type oscillator for generating a musical tone signal connected in series with the calculation circuit. The voltage control type oscillator is connected to an input of the phase comparator and another input of the phase comparator is connected to a circuit for producing a standard signal. A key signal generating circuit serves to generate a voltage corresponding to a depressed key and the key signal generating circuit is connected to an input of the calculation circuit, the key signal generating circuit being provided with a gate circuit which passes a key signal corresponding to a specific key. The gate circuit and the sample hold circuit have control electrodes connected to the output of a monostable multi-vibrator whose operation is controlled by a tuning switch.

10 Claims, 6 Drawing Figures

APPARATUS FOR AUTOMATICALLY TUNING AN ELECTRONIC MUSICAL INSTRUMENT

FIELD OF THE INVENTION

This invention relates to an apparatus for the automatic tuning of an electronic musical instrument using a voltage controlled type oscillator.

BACKGROUND

Hitherto, for tuning an electronic musical instrument, such a means has been employed in which an oscillation tone is generated and an operator effects a manual adjustment while listening to the tone or an oscillation frequency is measured and is manually adjusted to be in conincidence with a predetermined oscillation frequency. These means are, however, disadvantageous in that they require much trouble and are difficult for an amateur.

SUMMARY OF THE INVENTION

An object of this invention is to provide an apparatus in which for removing such disadvantages tuning can be carried out automatically by operation of a tuning switch.

The apparatus in accordance with the invention comprises a phase comparator, a converter circuit for converting an output signal of the phase comparator into a voltage at a level corresponding thereto, a sample hold circuit, a calculation circuit and a voltage controlled type oscillator for generating a musical tone signal connected in series, and an output terminal of the voltage controlled type oscillator connected to an input terminal of the phase comparator and another input terminal of the phase comparator formed as an input terminal for a standard signal, and an output terminal of a key signal generating circuit for generating a voltage corresponding to a depressed key connected to a calculation input terminal of the foregoing calculation circuit, the key signal generating circuit being provided with a gate circuit which generates a key signal corresponding to a specific key, and control electrodes of the gate circuit and the sample hold circuit connected to an output terminal of a monostable multi-vibrator which is operated by operation of a tuning switch.

Embodying examples of this invention will next be explained with reference to the accompanying drawings.

DETAILED DESCRIPTION

Figure 1:
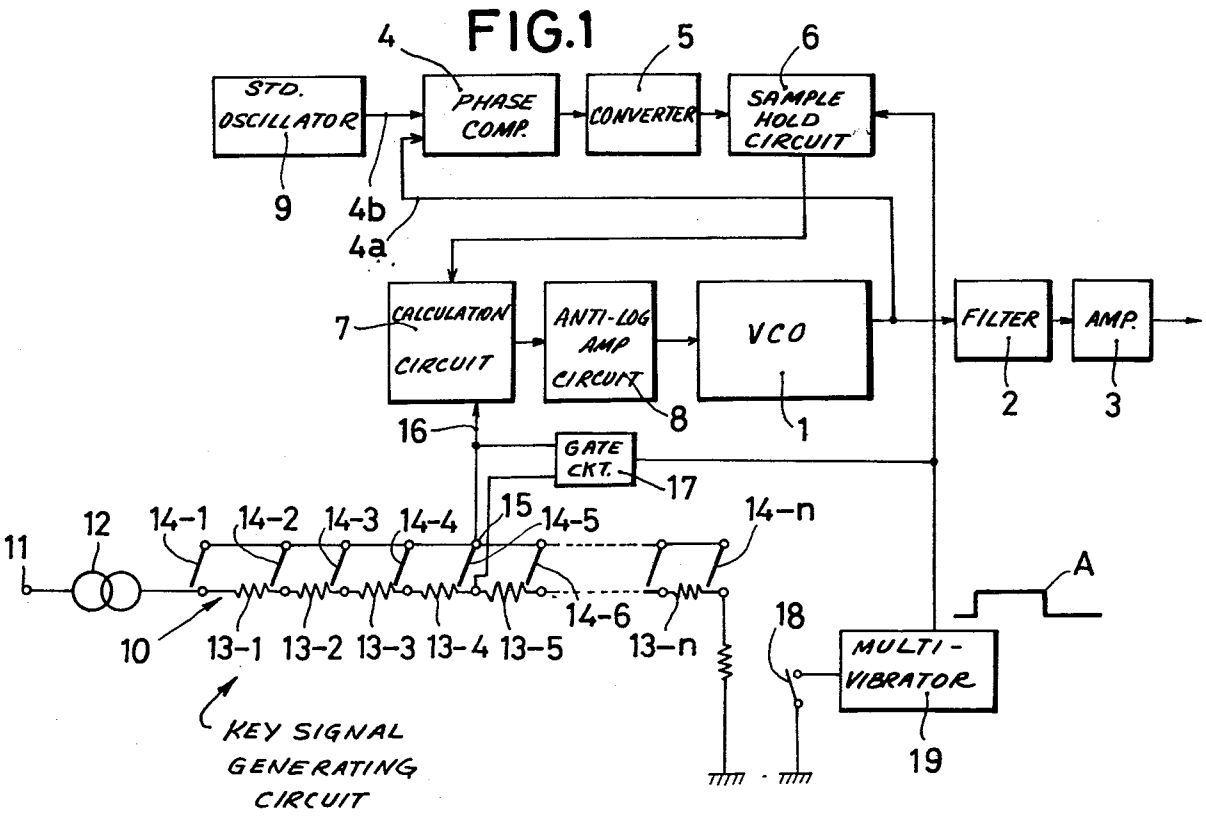
FIG. 1 is a block diagram showing one embodiment according to this invention.

Referring to FIG. 1, numeral 1 denotes a voltage controlled type oscillator for generating a musical tone signal (called hereinafter VCO 1) and an output terminal of VCO 1 is connected to a speaker through a voltage controlled type filter 2 (called hereinafter VCF 2) and a voltage controlled type amplifier 3 (called hereinafter VCA 3).

Numeral 4 denotes a phase comparator, and an output terminal thereof is connected to a control electrode of VCO 1 through a converter circuit 5 for converting an output signal of the phase comparator 4 into a voltage at a level corresponding thereto, e.g., a low-pass filter 5, a sample hold circuit 6, a calculation circuit 7 and an anti-log amplifier 8. An output terminal of VCO 1 is connected to an input terminal 4*a* of the phase comparator 4 and another input terminal 4*b* of the phase comparator 4 is connected to a standard signal oscillator 9. Numeral 10 denotes a key signal generating circuit for generating a voltage corresponding to a key which is depressed, the key signal generating circuit 10 comprising a plurality of resistances 13-1 . . . 13-n which are connected in series with one another and are connected through a constant current circuit 12 to a power source 11, and a plurality of key switches 14-1 . . . 14-n connected at respective end terminals to respective connecting points of resistances 13-1 . . . 13-n, the other end terminals of the key switches 14-1 . . . 14-n being connected together to form a common terminal 15, an output terminal 16 from circuit 10 being connected to a calculation input terminal of the calculation circuit 7.

Numeral 17 denotes a gate circuit connected in parallel with a specific key switch 14-5, and a control electrode of the gate circuit 17 and a control electrode of the sample hold circuit 6 are connected to an output terminal of a monostable multi-vibrator 19 arranged to be operated by operation of a tuning switch 18.

The calculation circuit 7 may be either an addition circuit or a subtraction circuit, but it will be described with reference to the case where the addition circuit is used.

A circuit composed of the phase comparator 4, the low-pass filter 5, the sample hold circuit 6, the calculation circuit 7, the anti-log circuit 8 and the VCO 1 forms a phase-locked loop (PLL), and the operation of the apparatus will be explained hereinafter with respect to the operational principle of the PLL.

If the tuning switch 18 is pushed to closed position, a pulse A is generated from the monostable multi-vibrator 19 and this pulse A not only opens the gate circuit 17 but also releases the sample hold circuit 6 from its holding state. Thus, the VCO 1 oscillates and its output signal is applied to the phase comparator 4 along with the standard signal of the oscillator 9 applied thereto, so that the two signals may be compared to one another in phase or frequency. If a difference therebetween in phase or in frequency is detected, a difference signal is supplied to the low-pass filter 5 for being converted into a voltage signal of a magnitude corresponding thereto. This voltage signal is applied through the sample hold circuit 6 to the calculation circuit 7, and there is carried out in this calculation circuit 7 an addition thereof to an output voltage of the specific key-switch 14-5 through the gate circuit 17. The resultant signal thereof is applied through the anti-log amplifier 8 to the VCO 1, and, the the VCO 1 oscillates in such a condition that the oscillation frequency thereof has been made equal to the input frequency of the standard signal input terminal 4*b* of the phase comparator 4.

If, thereafter, the output signal A of the monstable multi-vibrator 19 vanishes, the gate circuit 17 is closed and the sample hold circuit 6 is brought into its hold condition. Thus, the voltage at that time held in the sample hold circuit 6 is thereafter taken out so as to be applied to the calculation circuit 7, so that the VCO 1 under goes an oscillation as already has been tuned to the standard signal.

The standard signal input terminal 4b of the phase comparator 4 is connected to the standard signal oscillator 9 in the embodiment shown in FIG. 1, but such a modification can be considered that the same may be connected to an output terminal of an oscillator of a corresponding frequency in another electronic musical instrument, whereby to the other musical instrument can be effected.

Figure 2:
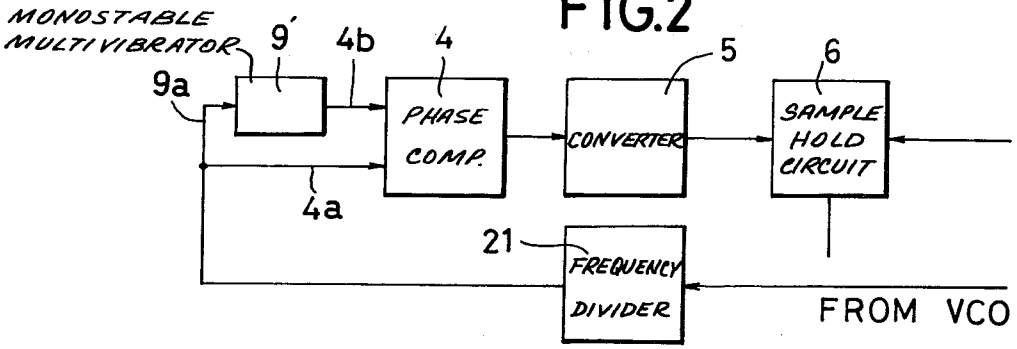
FIGS. 2 and 3 are block diagrams showing respective portions of other embodiments thereof.

A modification can also be considered, as shown in FIG. 2, in which the standard oscillator 9 is replaced by a monostable multi-vibrator 9', and an output terminal of the VCO 1 is diverged so as to be connected to an input terminal 9*a* of the monostable multi-vibrator 9'. If, in this case, the frequency which is to be tuned is high, a frequency divider 21 is interposed in a circuit connected between the output terminal of the VCO 1 and the input terminals 4*a*, 4*b*. Thus, the loop is locked when the output pulse width of the VCO 1 and the output pulse width of the monostable multi-vibrator 9' become equal one to another.

Figure 3:
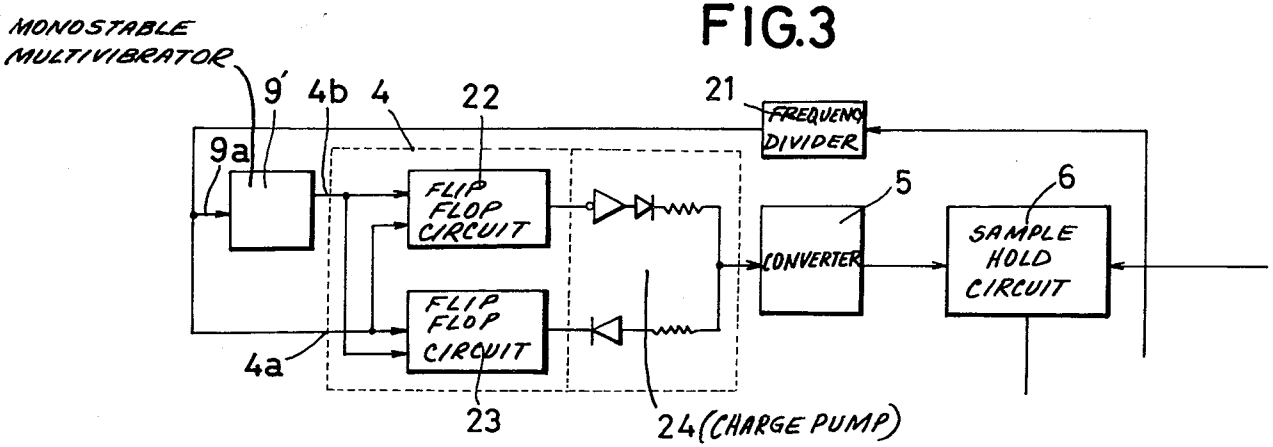

As shown in FIG. 3, the phase comparator 4 comprises two flip-flop circuits 22,23 and a charge pump 24. The flip-flop circuits 22,23 comprise a D-type flip-flop in which when the data terminal D is "H," the output is "H" by change of the input terminal T from "H" to "L," and when the data terminal D is "L," the output is "L" by the input terminal T being "L."

Figure 4:
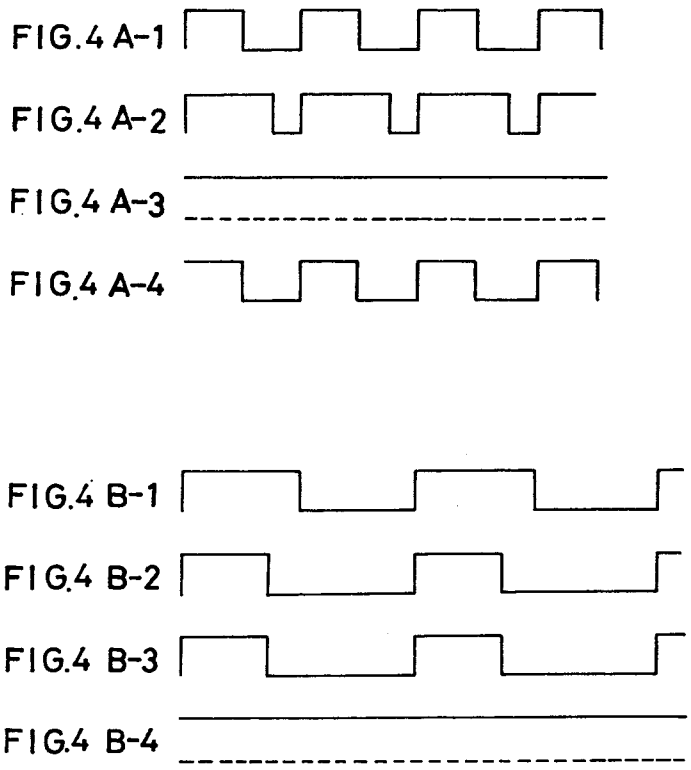
FIGS. 4 A-1 . . . A-4, B-1 . . . B-4 are diagrams for explaining the operation of a phase comparator shown in FIG. 3.

If, now, the oscillation frequency of the VCO 1 is higher than the standard frequency, the output of the frequency divider 21 is as shown in FIG. 4 A-1, and the output of the monostable multi-vibrator 9' is as shown in FIG. 4 A-2. Accordingly, it will be clear that the output signals of the output terminals F22, F23 are as shown in FIGS. 4 A-3, A-4. Accordingly, the input terminal PD of the charge pump 24 is applied with "H," and the same is inverted by the invertor 24*a*. The input terminal PU is applied with "L." Thus, the output of the diode 24*b* is pulled in by "L" of the anode of the diode 24*c*, and the output of the output terminal 24*d* of the charge pump 24 rapidly becomes "L." This "L" is applied through the low-pass filter 5 to the sample hold circuit 6, and the sampling condenser is discharged and the oscillation frequency of the VCO is lowered.

If the oscillation frequency of the VCO1 is lower than the standard frequency, the output of the frequency divider 21 becomes as shown in FIG. 4 B-1. The output of the monostable multi-vibrator 9' becomes as shown in FIG. 4 B-2. Accordingly, it will be clear that the output signals of the output terminals F22, F23 are as shown in FIGS. 4 B-3, B-4.

Accordingly, the input terminal PD of the charge pump 24 is applied with "L," and the same is inverted by the invertor 24*a* and the anode of the diode 21*b* is applied with "H." Additionally, the input terminal PU is applied with "H." Thus, the "H" of the anode of the diode 21*b* is pulled in by the diode 21*c* and the output terminal 24*d* rapidly becomes "H." This output is applied through the low-pass filter 5 to the sampling condenser of the sample hold circuit 6 for the charging the same, whereby the oscillation frequency of the VCO is increased.

Thus, it is repeated that the oscillation frequency of the VCO is lowered and if lowered in excess the same is increased, and the oscillation frequency closes to the standard value as near as possible.

In this case, the low-pass filter 5 has direct current in its input, so that the same does not especially act on the loop. The filter acts only for removing unnecessary signals at the time of excess degree response operation and the like.

Figure 5:
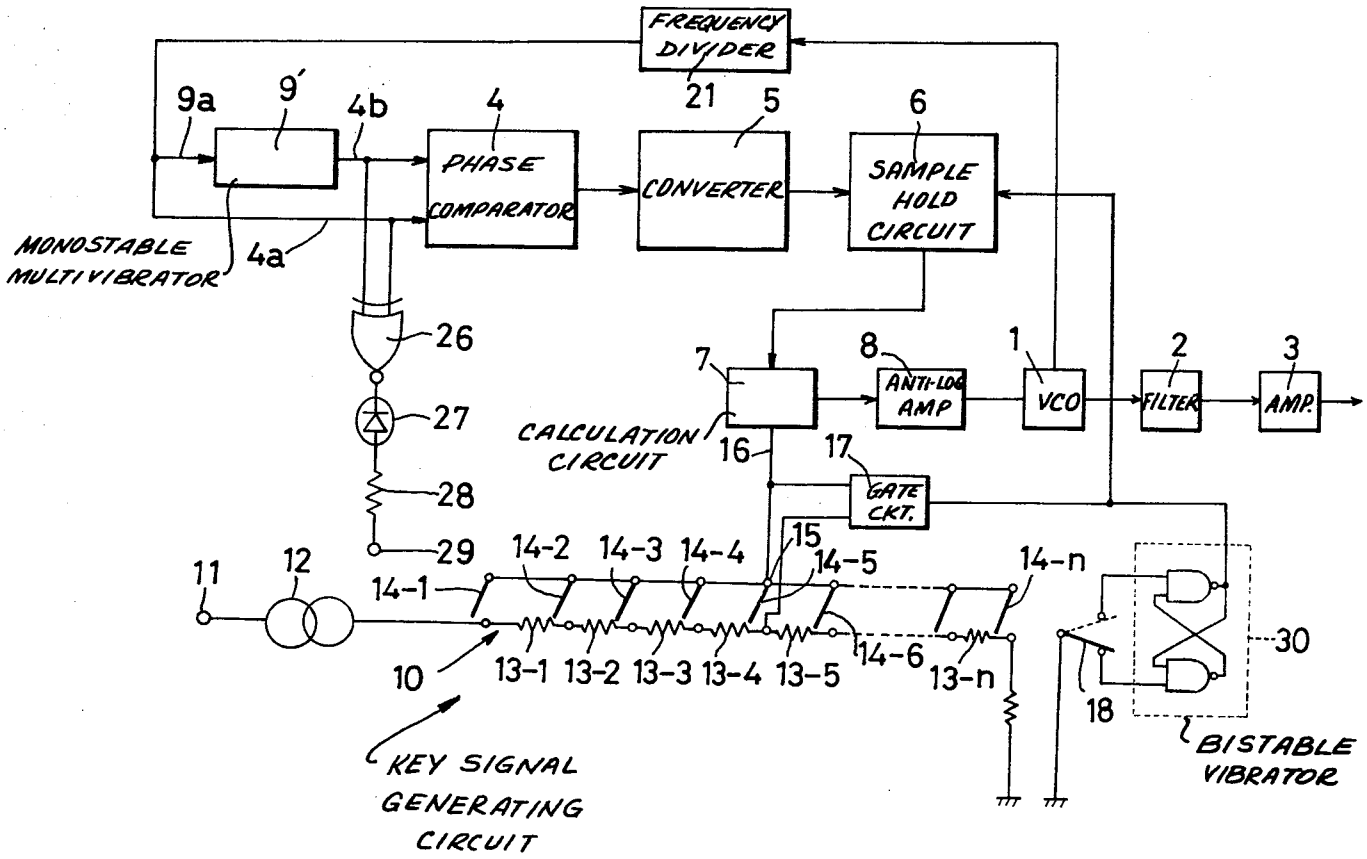
FIG. 5 is a block diagram of another embodiment example of this invention.

FIG. 5 shows another embodiment in which the two input terminals 4*a*, 4*b* of the phase comparator 4 are connected through a logical circuit 26 to a luminous element 27. The luminous element 27 comprises a luminous diode and the logical circuit 26 comprises an Ex-NOR circuit. The cathode of the luminous diode 27 is connected to the output terminal of the Ex-NOR circuit 26 and the anode thereof is connected through a resistance 28 to a power source 29. Thus, the output signal of the Ex-NOR circuit 26 is "1" when an output pulse of the frequency divider 21 and an output pulse of the monostable multi-vibrator 9' coincide one with another, and the output signal thereof is "0" when the two pulses are not coincident so that for the output "0" at the time of non-coincidence an electric current flows from the power source 29 through the luminous diode 27, so that the luminous diode 27 goes on. With the output "1" at the time of the coincidence, the luminous diode 27 is de-energized, so that it goes out.

Thus, if tuning is being effected in almost the same manner as in the foregoing case of FIG. 1 by pushing of the tuning switch 18, as long as the two pulse signals applied to the two input terminals 4*a*, 4*b* of the phase comparator 4 are partly different in phase, the luminous diode 27 goes on and off, and when the two pulses are completely coincident in phase, the diode goes completely out, and thereby it is indicated that the oscillation frequency of the VCO 1 has reached a predetermined value.

In the embodiment of FIG. 5, the tuning switch 18 is of a changeover type and a bistable multi-vibrator 30 is provided instead of the monostable multi-vibrator 19 so that an output signal obtained while the tuning switch 18 is pushed (as shown by dotted lines) may serve to open the gate circuit 17 and release holding of the sample hold circuit 6 whereas when the tuning switch 18 is released the gate circuit 17 may be opened and the sample hold circuit 6 may be brought into its hold condition. Accordingly, the tuning can be achieved by releasing the tuning switch 18 when the luminous diode 27 goes out completely.

The sample hold circuit 6 is composed of a circuit including a holding condenser, so that when the hold of the circuit 6 is released, the output voltage corresponding thereto is sent out therefrom and when the circuit 6 is brought into its hold condition the output voltage of the low-pass filter 5, at the moment when the loop is locked, is charged therein, so that voltage corresponding thereto is sent out and this output is continued. However, the holding condenser often discharges little by little over a long lapse of time and the hold voltage is varied, and, thus, it comes to be out of tune. Accordingly, it becomes necessary for the tuning switch to be pushed frequently.

Any of such modifications can be considered also in this embodiment in which the standard signal is applied from another electronic musical instrument, instead of application from the standard signal oscillator 9, the standard signal oscillator 9 is replaced by a monostable multi-vibrator 9' as shown in FIG. 3, such an indicating device as shown in FIG. 5 is provided, or the tuning switch 18 and the monostable multi-vibrator 19 are replaced by the tuning switch 18' and bistable multivibrator 30 as shown in FIG. 5.

Thus, according to this invention, tuning can be automatically effected in a short time merely by operating a tuning switch and can be carried out simply even by unskilled personnel.

What is claimed is:

1. An apparatus for the automatic tuning of an electronic musical instrument comprising a phase comparator having two inputs, converter means connected to said comparator for producing a signal corresponding to the output of the comparator, calculator means having first and second inputs, said first input of said calculator means being connected to said converter means, voltage controlled oscillator means for generating a musical tone signal having an output connected to one of said inputs of said phase comparator, means connected to the other input of the phase comparator for applying a standard signal thereto, key signal generating means including a plurality of keys for generating a voltage corresponding to an actuated key, said key signal generating means having an output connected to said second input of said calculator means, said key signal generating means including a gate means for passing a key signal corresponding to a specific key, and multi-vibrator means including control switch means coupled to said gate means and said converter means.

2. Apparatus as claimed in claim 1 wherein said means for applying a standard signal to the phase comparator comprises a standard signal oscillator.

3. Apparatus as claimed in claim 1 wherein said means for applying a standard signal to the phase comparator comprises an oscillator provided in another electronic musical instrument.

4. Apparatus as claimed in claim 1 comprising a luminous element and a logic circuit connecting said luminous element to said inputs of the phase comparator.

5. Apparatus as claimed in claim 1 wherein said means for applying a standard signal to said other input of the phase comparator comprises a monostable mulitvibrator having an input coupled to said voltage controlled oscillator means and an output connected to said other input of the phase comparator.

6. Apparatus as claimed in claim 5 comprising a frequency divider connected in series between the output of the voltage controlled oscillator means and the input of the monostable multi-vibrator.

7. Apparatus as claimed in claim 1 wherein said converter means comprises a converter circuit connected to said conparator for converting an output signal of the comparator into a voltage of corresponding amplitude and a sample hold circuit connected in series with the converter circuit, said multi-vibrator means being connected to said sample hold circuit.

8. Apparatus as claimed in claim 1 wherein said converter means comprises a low-pass filter.

9. Apparatus as claimed in claim 7 wherein said phase comparator comprises two flip-flop circuits.

10. Apparatus as claimed in claim 7 wherein said phase comparator comprises two flip-flop circuits and a charge pump.

* * * * *

UNITED STATES PATENT AND TRADEMARK OFFICE

CERTIFICATE OF CORRECTION

PATENT NO. : 4,077,298

DATED : March 7, 1978

INVENTOR(S) : KONDO

It is certified that error appears in the above-identified patent and that said Letters Patent are hereby corrected as shown below:

Front Page, end of second column: change "10 Claims, 6 Drawing Figures" to --10 Claims, 5 Drawing Figures--

Figure 6:
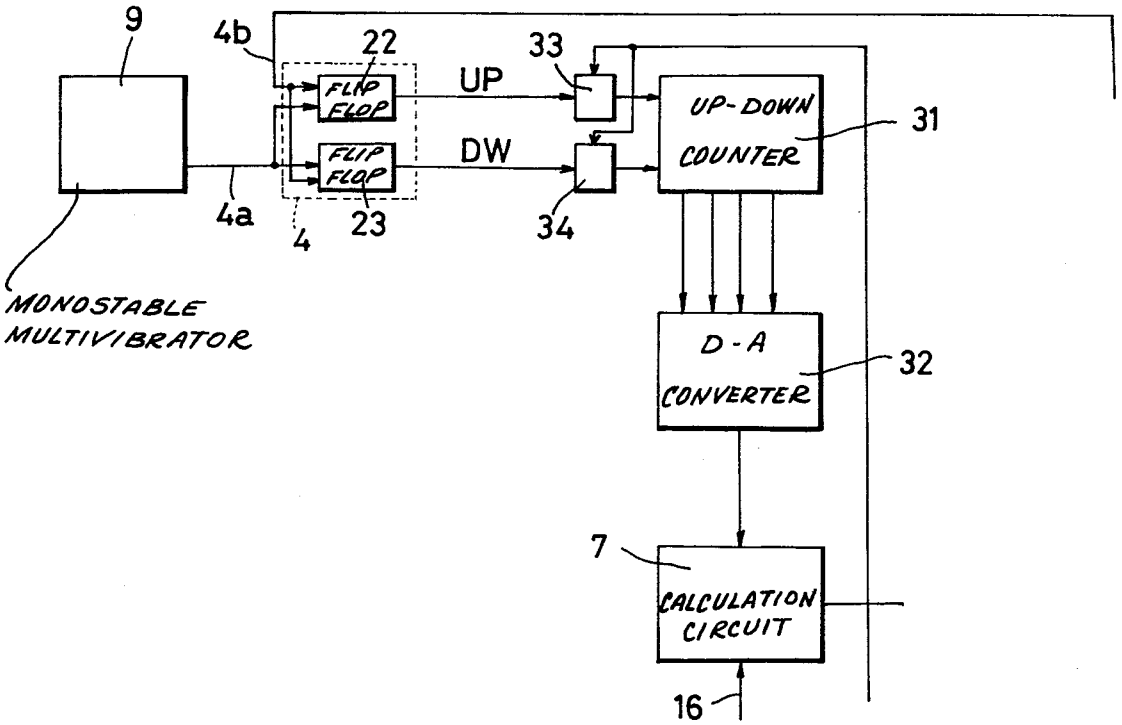

Delete Figure 6

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*